US006817422B2

(12) United States Patent
Jordan

(10) Patent No.: US 6,817,422 B2
(45) Date of Patent: Nov. 16, 2004

(54) AUTOMATED RISER RECOIL CONTROL SYSTEM AND METHOD

(75) Inventor: Larry Russell Jordan, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 3 days.

(21) Appl. No.: 10/276,411

(22) PCT Filed: May 15, 2001

(86) PCT No.: PCT/US01/15623

§ 371 (c)(1),
(2), (4) Date: Nov. 14, 2002

(87) PCT Pub. No.: WO01/88323

PCT Pub. Date: Nov. 22, 2001

(65) Prior Publication Data

US 2003/0205383 A1 Nov. 6, 2003

Related U.S. Application Data

(60) Provisional application No. 60/204,442, filed on May 15, 2000.

(51) Int. Cl.[7] ..... E21B 19/00; E21B 23/00

(52) U.S. Cl. ..... 166/381; 166/355; 175/7; 175/27

(58) Field of Search ..... 166/355, 335, 166/352, 381; 175/5, 7, 27, 85

(56) References Cited

U.S. PATENT DOCUMENTS

| | | | | |
|---|---|---|---|---|
| 3,653,635 | A | 4/1972 | Bates, Jr. et al. | |
| 4,121,806 | A | 10/1978 | Iato et al. | 254/172 |
| 4,351,261 | A | 9/1982 | Shanks | 114/264 |
| 4,432,420 | A | 2/1984 | Gregory et al. | 166/355 |
| 4,466,488 | A | 8/1984 | Nayler et al. | 166/355 |
| 4,487,150 | A | 12/1984 | Shanks | 114/264 |
| 4,501,219 | A | 2/1985 | Bates, Jr. | 114/264 |
| 4,638,978 | A | 1/1987 | Jordan | 254/228 |
| 4,759,256 | A | 7/1988 | Kovit et al. | 91/29 |
| 4,962,817 | A | 10/1990 | Jones et al. | 175/166 |
| 5,209,302 | A | 5/1993 | Robichaux et al. | 166/355 |

*Primary Examiner*—David Bagnell
*Assistant Examiner*—Jennifer Gay
(74) *Attorney, Agent, or Firm*—Michael P. Hartmann; Peter J. Bielinski

(57) ABSTRACT

An automated riser recoil control system (10) including a plurality of riser tensioners (20), a vessel heave measurement system (210) and a control processor (70) with each tensioner (20) having a piston travel indicator (27) which signals the processor (70) and a method of operation is disclosed.

15 Claims, 4 Drawing Sheets

AUTOMATED RISER RECOIL CONTROL SYSTEM AND METHOD

RELATED APPLICATIONS

This application claims the benefit under Title 35 of the United States Code §119(e) of U.S. Provisional Patent Application No. 60/204,442, filed May 15, 2000.

TECHNICAL FIELD

This invention relates generally to a system and method for providing a motion-compensated drilling rig platform. More particularly, the invention relates to an automated system and method which can be used to control marine riser disconnection events and riser tensioner wireline breaks in conjunction with such a platform.

HISTORY OF RELATED ART

Drilling operations conducted from a floating vessel require a flexible tensioning system which operates to secure the riser conductor between the ocean floor (at the well head) and the rig, or vessel. The tensioning system acts to reduce the effects of vessel heave with respect to the riser, control the effects of both planned and unplanned riser disconnect operations, and to mitigate the problems created by unexpected breaks or faults in the riser (hereinafter a "disconnect event").

Riser tensioner devices, which form the heart of the tensioning system, have been designed to assist in the management of riser conductors attached to drilling rigs, especially with respect to movement caused by periodic vessel heave. A series of these tensioners, connected to the riser using cables and sheaves, react to relative movement between the ocean floor and the vessel by adjusting the cable length to maintain a relatively constant tension on the riser. Any number of tensioners, typically deployed in pairs, may be used to suspend a single riser from the vessel.

Unexpected events may occur during offshore drilling operations. These may be realized in the form of tensioner wireline breaks, severe storms, or other circumstances which require the vessel/rig operator to act quickly to adjust the tension applied to the riser. The riser may also become disconnected from the wellhead for various reasons.

The need to respond to an unexpected riser disconnect event, or tensioner wireline break, and manage the recoil tension or "slingshot" effect on the vessel induced thereby, provides the motivation to develop an automated system and method to control the movement of individual tensioners. The system and method should operate by managing the tension applied to the riser using the cables attached to the riser and the riser tensioners in response to sensing an irregular travel velocity experienced by one or more of the tensioners, such as may be caused by a disconnect event or tensioner wireline break. Thus, the system and method should be simple, robust, and fully automatic, such that system elements are capable of responding to and continuously managing a disconnect event or tensioner wireline break in an automated fashion more rapidly and reliably than is possible using human operators.

SUMMARY OF THE INVENTION

In one embodiment, the automated riser recoil control system includes a plurality of riser tensioners, a vessel heave measurement system, and a control processor in electrical communication with the heave measurement system and the riser tensioners. Each tensioner includes a piston travel indicator which provides a piston travel signal to the processor, while the vessel heave measurement system provides a heave velocity signal to the processor.

The processor monitors each of the piston travel signals along with the heave velocity signal so as to be able to determine whether a preselected number of piston travel velocities (determined from the piston travel signals) exceed the vessel heave velocity by some critical velocity difference. For example, if sixteen riser tensioners are used to suspend the marine riser from the heaving vessel, and at least four of the tensioners show a piston travel velocity which exceeds the heave velocity by more than about one foot per second (value is typically between about 4–6 feet/second cable speed or about 1.25 feet/second tensioner piston velocity), then the processor, which is in controlling communication with each one of the riser tensioners, can react by controlling the force applied to the riser by controlling the rate of fluid flow within one or more of the tensioners.

Typically, each of the riser tensioners includes an accumulator chamber (blind end of the tensioner) and a piston bore chamber (rod end side of the tensioner), and the fluid flow is controlled within the piston bore chamber. To control the fluid flow, an orifice-controlled fluid valve is typically placed in fluid communication with the piston bore chamber. To further control movement of the tensioner, an air shutoff valve is typically placed in fluid communication with the accumulator chamber and a bank of high pressure air cylinders. Timers may be applied to adjust the time within which the orifice-controlled fluid valves and air shutoff valves are closed. Finally, to prevent extreme movement of the tensioner, a fluid volume speed control valve may also act to limit the volumetric rate of fluid flow in the piston bore chamber upon sensing an extreme fluid flow rate within the tensioner.

In another embodiment, a method for adjusting at least one of the tension forces applied by the tensioners to the riser includes the steps of determining the piston travel velocity for each riser tensioner, measuring the heave velocity of the vessel, calculating the velocity differences between each of the piston travel velocities and the heave velocity, and adjusting the tension force after determining that some preselected number of the velocity differences exceeds a preselected critical velocity difference (selected by the operator). Again, control of the tension force is typically effected by throttling the rate of at least one fluid flow within one or more of the plurality of riser tensioners. Air shutoff valves, orifice-controlled fluid valves, and fluid volume speed control valves are all used as previously described.

BRIEF DESCRIPTION OF THE DRAWINGS

A more complete understanding of the structure and operation of the present invention may be had by reference to the following detailed description taken in conjunction with the accompanying drawings, wherein.

DETAILED DESCRIPTION OF PRESENTLY PREFERRED EXEMPLARY EMBODIMENTS

Figure 1:
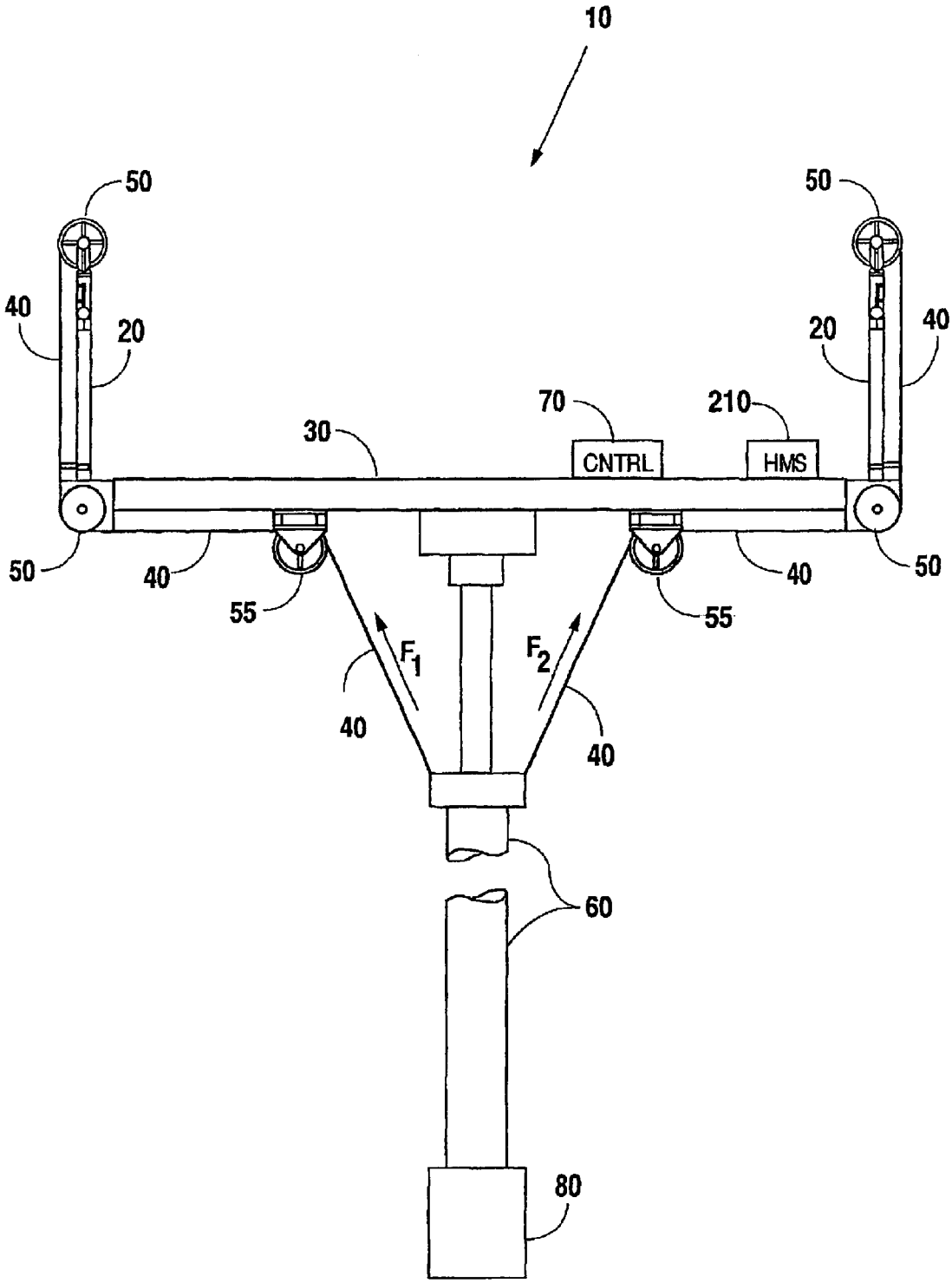
FIG. 1 is a planar side view of the automated riser recoil control system of the present invention mounted to a heaving vessel from which a marine riser is suspended.

Referring now to FIG. 1, it can be seen that the automated riser recoil control system (10) of the present invention includes a plurality of riser tensioners (20) in mechanical communication with a heaving vessel (30) and a marine riser (60). Each one of the tensioners (20) applies a corresponding individual tension force (F1, F2) to the riser (60) under heaving conditions, as the vessel (30) responds to ocean wave movement. The tension forces (F1, F2) are substantially proportional to the rate of at least one fluid flow within the tensioner. For a more detailed view of an individual riser tensioner, as shown in a dual-tensioner version, see FIG. 2.

The individual riser tensioners (20) are substantially equivalent to, or identical to, the cable tensioners disclosed in U.S. Pat. Nos. 4,351,261 and/or 4,638,978 (incorporated herein by reference in their entirety). Each riser tensioner (20) may also be similar to or identical to each of the tensioners that make up the dual tensioner depicted in FIG. 2, which may be purchased from Retsco International, L.P. as Retsco Part No. 112552.

Figure 2:
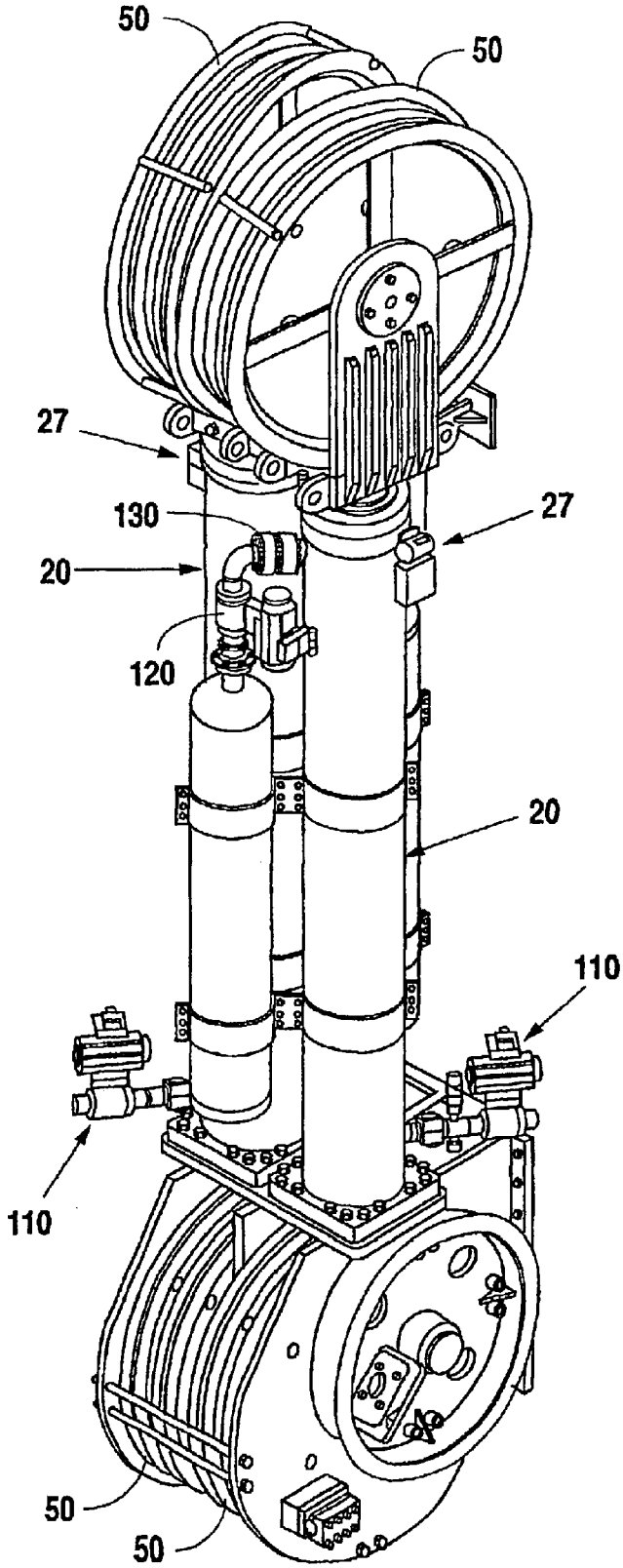
FIG. 2 is a close-up perspective view of a typical riser tensioner (in dual form)

As can be seen more clearly in FIG. 2, each riser tensioner (20) includes a tensioner piston travel indicator (27) which may be a wireline encoder that supplies a distance travel signal for the piston within the tensioner (20). The travel indicator (27) may also take the form of a velocity measurement device, or an acceleration measurement device. In any event, the travel indicator (27) provides a signal which indicates the travel of the piston within the tensioner (20) as the cable (40) moves in reaved engagement with the sheaves (50) and the riser (60). The riser tensioner (20) typically includes an accumulator chamber in fluid communication with an air shutoff valve (110) and a piston bore chamber in fluid communication with an orifice-controlled fluid valve (120). To prevent extreme movement of the tensioner piston, a fluid volume speed control valve (130) is often inserted between the orifice-controlled fluid valve (120) and the piston bore chamber of the tensioner (20). The operational details of the speed control valve (130) are more fully described in U.S. patent application Ser. No. 09/733,227 (incorporated herein by reference in its entirety).

The air shutoff valve (110) may be equivalent to or identical to Retsco International, L.P. Part No. 113045. The orifice-control fluid valve (120) may be equivalent to or identical to Retsco International, L.P. Part No. 113001. Finally, the fluid volume speed control valve (130) may be equivalent to or identical to Retsco International, L.P. Part No. 113102.

Thus, as can be seen in FIG. 1, the automated riser recoil system (10) operates to control the tension forces (F1, F2) applied to the riser (60) using the cables (40) in reaved engagement with the sheaves (50) of the tensioners (20), the downturn sheaves (55), and the riser (60).

Normally, as the vessel (30) heaves up and down in response to ocean wave movement, the tensioners (20) respond in a passive fashion by playing out, or taking up, cable (40) in phase with the movement of the vessel (30). This results in the application of substantially even forces (F1, F2) to the riser as it is suspended from a vessel (30) and connected to the wellhead (80).

However, at times, one or more of the cables (40) will break, causing a substantial imbalance in the tension forces (F1, F2). As the applied tension force from each tensioner (20) is relatively large (e.g., each tensioner supplies about 100,000 lbs. of force), the tensioner piston subjected to the wireline break will tend to move quite rapidly in reaction to the resulting lack of tension. Moreover, in other circumstances, the marine riser may become disconnected from the wellhead (80) due to unanticipated causes, or as a planned event (e.g., it is necessary to move the vessel (30) rapidly away from the drilling site in order to avoid a severe storm or other events).

When the control processor (70), in electrical communication with each one of the tensioner piston travel indicators (27) and the vessel heave measurement system (210), determines that one or more of the tensioners (20) has begun to move in such an uncontrolled fashion, the processor (70) begins to take action to control the forces (F1, F2) applied to the riser (60).

Figure 3:
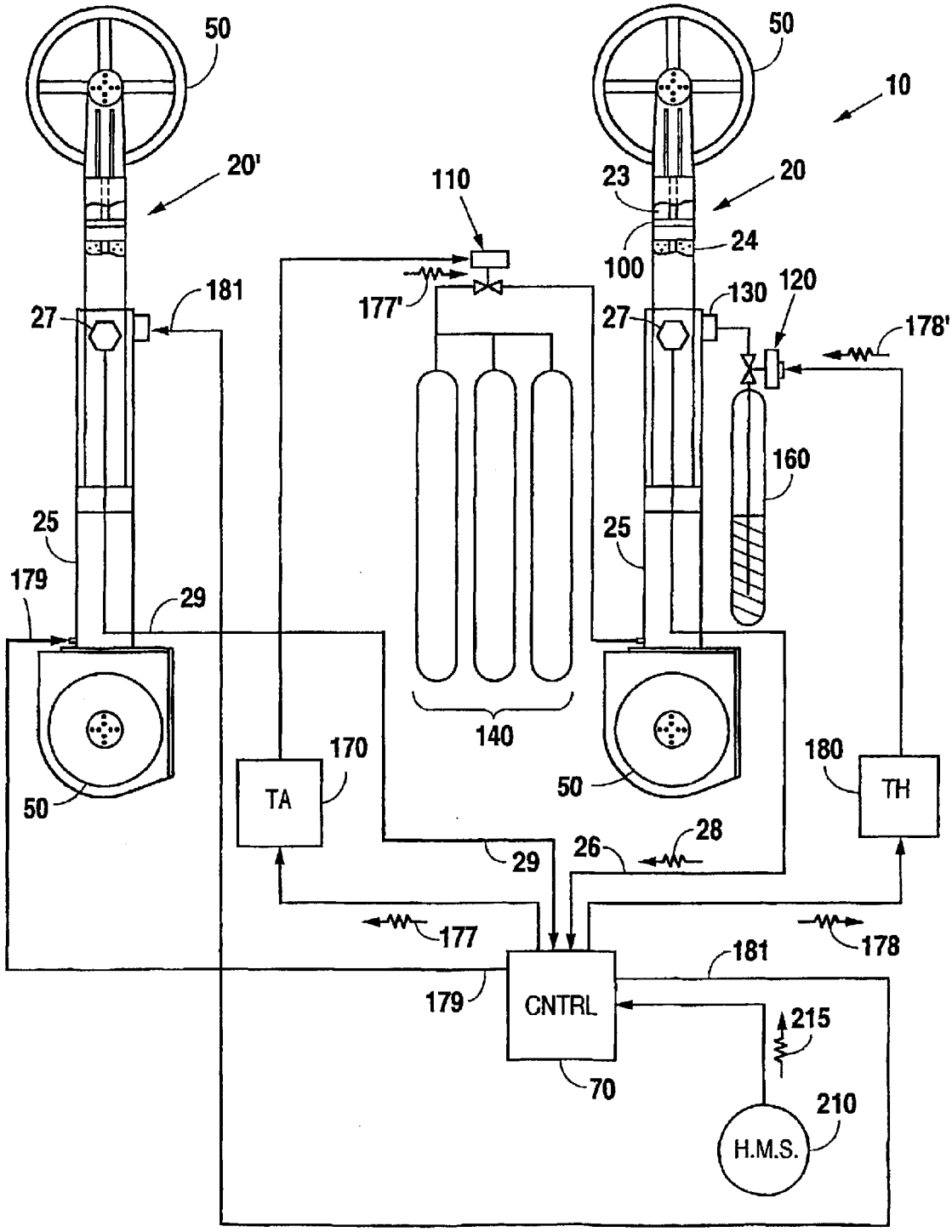
FIG. 3 is a schematic block diagram of the automated riser recoil control system of the present invention.

For example, referring now to FIG. 3, it can be seen that each individual tensioner (20) supplies a piston travel signal (28) using communication line (26) to the processor (70). Of course, the travel indicator (27) may be replaced by a velocimeter or an accelerometer to provide velocity and/or acceleration signals (28) directly to the processor (70), as described above. Similarly, the heave measurement system (210) provides a heave velocity signal (215) to the processor (70). However, there are many sensors and systems available, and known to those skilled in the art, which can provide distance and/or acceleration signals (215) to the processor (70) from the heave measurement system (210), since the vessel heave measurement system typically includes one or more tri-axial accelerometers and a bi-axis tilt sensor coupled to a processor which calculates heave, pitch and roll of the vessel. Thus, after a piston distance travel signal (or piston velocity signal, or piston acceleration signal), is received by the processor (70), it is converted to a velocity signal (as needed) and compared with the velocity signal (215) provided by the heave measurement system (210). Of course, in a similar fashion, the heave measurement system (210) may provide a distance signal or acceleration signal, which may be converted into a velocity signal, as needed. The processor (70), in turn, is thus in electrical communication with each one of the tensioner piston travel indicators (27) and the vessel heave measurement system (210) and is thereby enabled to monitor each of the piston travel signals (28) and the heave velocity signal (215).

It should be noted that numerous other control and communication signal lines (29, 179 and 181) can be used to place the processor (70) in controlling communication (i.e., electrical, mechanical, hydraulic, or some combination of these) with any number of other tensioners (20'). Thus, for example, the tensioner (20') can supply a piston travel signal to the processor (70) using the signal line (181). The tensioner (20') may, in turn, be controlled by the processor (70) using the air shutoff control valve signal line (179) and the orifice-controlled fluid valve signal line (181). Any number of tensioners (20, 20') can be placed in controlling communication with the processor (70) in this fashion.

Therefore, when the velocity of the piston (100) within the tensioner (20) exceeds the velocity measured by the heave measurement system (210) by some preselected critical velocity difference (e.g., the critical value is typically selected by the operator to be between about 4–6 feet/second of cable (40) speed or about 1.25 feet/second piston velocity), the processor (70) can operate to control the fluid (24) flow within the tensioner (20), typically using the orifice-controlled fluid valve (120) to control the fluid flow (24) within the piston bore chamber (23). The processor (70) may also operate to control the air shutoff valve (110), which controls the flow of air from the bank of cylinders (140) and the accumulator chamber (25) of the tensioner (20).

For example, the processor (70) may send a throttling signal (178) to the orifice-control fluid valve (120) to adjust the valve (120) opening, which regulates the flow of fluid from the accumulator (160) into and out of the piston bore chamber (23). For additional flexibility, a delay timer (180) can be used to delay the onset of valve closure for the valve (120) from the time that the signal (178) is asserted by the processor (70). Similarly, the processor (70) may send a signal (177) to the air shutoff valve (110) to isolate the accumulator chamber (25) within the tensioner (20) from the air bank (140). Again, for additional flexibility, a delay timer (170) may be inserted into the communication line between the processor (70) and the valve (110) so as to delay the onset of the air valve (110) closure from the time the signal (177) is asserted. For reference purposes, the signals (177', 178') represent delayed signals (177, 178) respectively. Although not shown in FIG. 3, additional timers may also be inserted into the communication lines (179, 181). The timer delay periods can be zero, or any other value selected by the system (10) operator.

Figure 4:
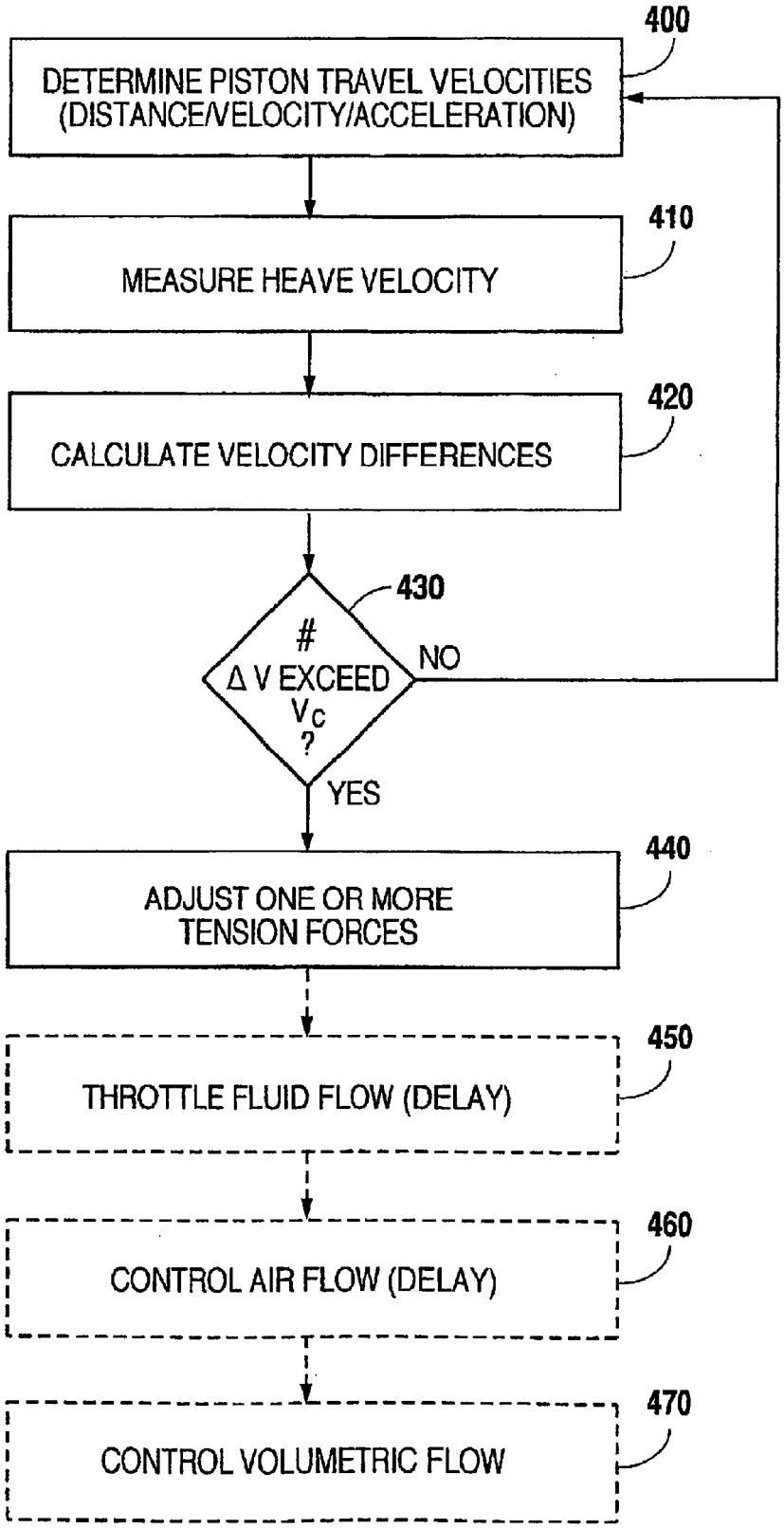
FIG. 4 is a flow chart diagram of the method of the present invention.

Turning now to FIG. 4, the method for adjusting at least one tension force (F1) selected from the plurality of tension forces (F1, F2) applied by the tensioners (20) to the marine riser (60) can be seen. The method begins at step (400) with determining the piston travel velocities for all of the tensioners (20) used to suspend the riser (50) from the vessel (30). As mentioned above, this typically occurs after receiving the piston travel signals supplied from the indicator (27) attached to each of the tensioners (20). The method continues in step (410) with measuring the heave velocity experienced by the heaving vessel (30) as it reacts to wave motion. The heave velocity is typically determined by the processor (70) using the signal supplied from the heave measurement system (210), which indicates the heave velocity of the vessel (30).

The method then continues by calculating a plurality of velocity differences, wherein each one of the velocity differences corresponds to the difference between a selected one of the piston travel velocities and the heave velocity. This occurs in step (420). Finally, if a selected number of velocity differences (determined in step (420)) exceeds a preselected critical velocity difference (typically selected by the operator), as determined in step (430), then the tension force applied by one or more of the tensioners (20) is adjusted. This occurs in step (440).

The tension force (F1) may be adjusted by throttling the rate of the fluid flow within the tensioner using the orifice-controlled fluid valve (120) (step 450), controlling the air flow within the tensioner accumulator chamber using the air shutoff valve (110) (step 460), or controlling the volumetric rate of flow within the tensioner using the fluid volume speed control valve (130) (step 470). While the air shutoff valves (110) are typically completely open or completely closed, the orifice-controlled fluid valves (120) are typically set to a preselected flow limit value in the static condition (e.g., 50% of the maximum value), and are modulated to some selected flow rate between about 10% to about 95%, and most preferably to about 15% of the maximum flow rate permitted by the fully-opened valves (120). As noted above, timers (170, 180) can be inserted into the valve control lines for each of the tensioners (20) to delay the application of valve closure/throttling signals from the processor (70) to each selected tensioner (20). Thus, a timer (170) can be used to delay closure of the air shutoff valve (110) for a preselected delay time after the processor (70) has determined that the preselected number of velocity differences calculated in step (420) exceed the preselected critical velocity difference. Similarly, the timer (180) may be used to delay closure or throttling of the orifice-controlled fluid valve (120) for a preselected time period after determining that a preselected number of the velocity differences calculated in step (420) exceeds a preselected critical velocity difference.

The tension force (F1) applied by a tensioner (20) can thus be adjusted in a number of ways. The most common is by throttling the rate of at least one fluid flow within the selected tensioners. As mentioned above, this usually occurs by closing orifice-controlled fluid valves and air shutoff valves. In addition, for extreme piston movement conditions, the fluid volume speed control valve may operate independently, which acts to limit the volumetric rate of fluid flow in the tensioner piston bore chamber. The fluid volume speed control valve is typically not operated by the processor (70), but reacts to sensing a predetermined volumetric rate of flow which exceeds a predetermined critical volumetric rate of flow, as may be selected by the designer of the fluid volume speed control valve. Throughout this document, "fluid" may be considered to be air, oil, water, or any other substantially non-solid medium which is used to control movement of the tensioners.

The processor (70) is in electrical communication with the tensioner piston travel indicators (27) and the heave measurement system (210), and is thus able to continuously or discretely (at periodic or aperiodic intervals) determine the velocity of each individual riser tensioner piston (100) and that of the heaving vessel (30). The processor (70) adjusts the tension force applied by each tensioner (20) by controlling the rate of at least one fluid flow within each tensioner.

Numerous substitutions and modifications can be made to the system (10) as will be recognized by those skilled in the art. For example, the processor can be a microprocessor with a memory and program module, computer work station, a programmable logic controller, an embedded processor, a signal processor, or any other means capable of receiving the distance/velocity/acceleration signals provided by the tensioner piston travel indicators and the heave measurement system, and deriving velocities therefrom (if velocity is not directly supplied). The processor (70) must also be capable of calculating velocity differences between each of the pistons traveling within the riser tensioners, and the vessel heave velocity; comparing the velocity differences to a single critical velocity difference; counting the number of velocity differences which exceed the single critical velocity difference (for comparison to the preselected limit number); and commanding a preselected number of riser tensioners to adjust their individual tension forces applied to the riser.

Although preferred embodiments of the method and apparatus of the present invention have been illustrated in the accompanying Drawings and described in the foregoing Detailed Description, it will be understood that the invention is not limited to the embodiments disclosed, but is capable to numerous rearrangements, modifications and substitutions without departing from the scope of the invention as set forth and defined by the following claims.

What is claimed is:

1. An automated riser recoil control system, wherein the riser is suspended from a heaving vessel having a heave velocity, comprising:

a plurality of riser tensioners in mechanical communication with the vessel and the riser, wherein each one of said plurality of riser tensioners applies a corresponding individual tension force to the riser under heaving conditions, and wherein each one of the corresponding individual tension forces is substantially proportional to the rate of at least one fluid flow within a corresponding tensioner, and wherein each one of the corresponding tensioners includes a tensioner piston travel indicator adapted to provide a piston travel signal;

a vessel heave measurement system for measuring the heave velocity;

a processor in electrical communication with each one of the tensioner piston travel indicators and the vessel heave measurement system so as to monitor each one of the piston travel signals and the heave velocity signal, and in controlling communication with each one of the plurality of riser tensioners so as to control the rate of the at least one fluid flow within at least one of the plurality of tensioners upon determining that a preselected number of piston travel velocities determined from each one of the plurality of piston travel signals exceed the heave velocity by a preselected critical velocity difference; and, wherein at least one of the plurality of riser tensioners includes an air shutoff valve, further comprising a first timer adapted to delay closure of the air shutoff valve for a preselected first delay time period after determining that the preselected number of piston travel velocities determined from each one of the plurality of piston travel signals exceed the heave velocity by the preselected critical velocity difference.

2. The automated riser recoil control system of claim 1, wherein the processor adjusts a selected one of the individual tension forces applied to the marine riser by controlling the rate of the at least one fluid flow within a corresponding tensioner.

3. The automated riser recoil control system of claim 1, wherein at least one of the piston travel signals is a piston distance travel signal.

4. The automated riser recoil control system of claim 1, wherein at least one of the piston travel signals is a piston velocity travel signal.

5. The automated riser recoil control system of claim 1, wherein at least one of the piston travel signals is a piston acceleration travel signal.

6. The automated riser recoil control system of claim 1, wherein at least one of the plurality of riser tensioners comprises an accumulator chamber and a piston bore chamber, and wherein the at least one fluid flow within the cable tensioner passes through the piston bore chamber.

7. The automated riser recoil control system of claim 1, wherein at least one of the plurality of riser tensioners includes an orifice-controlled fluid valve, further comprising a second timer adapted to delay closure of the orifice-controlled fluid valve for a second preselected time period after determining that the preselected number of piston travel velocities determined from each one of the plurality of piston travel signals exceed the heave velocity by the preselected critical velocity difference.

8. The automated riser recoil control system of claim 1, wherein at least one of the plurality of riser tensioners includes a fluid volume speed control valve which acts to limit a volumetric rate of fluid flow in the at least one of the plurality of riser tensioners upon sensing a predetermined volumetric rate of flow in excess of a predetermined volumetric rate of flow.

9. A method for adjusting at least one tension force selected from a plurality of tension forces applied by a corresponding plurality of riser tensioners to a marine riser suspended from a heaving vessel, comprising the steps of:

determining a plurality of piston travel velocities experienced by the plurality of riser tensioners;

measuring a heave velocity experienced by the heaving vessel;

calculating a plurality of velocity differences, wherein each one of the plurality of velocity differences corresponds to a difference between a selected one of the plurality of piston travel velocities and the heave velocity;

adjusting the at least one tension force upon determining that a preselected number of the plurality of velocity differences exceed a preselected critical velocity difference; and, wherein at least one of the plurality of riser tensioners includes an air shutoff valve, and wherein a timer delays closure of the air shutoff valve for a preselected delay time period after determining that the preselected number of the plurality of velocity differences exceed a preselected critical velocity difference.

10. The method of claim 9, wherein at least one of the plurality of riser tensioners applies a corresponding individual tension force to the riser in proportion to a rate of at least one fluid flow within the at least one of the plurality of tensioners, and wherein the step of adjusting the at least one tension force is accomplished by throttling the rate of at least one fluid flow within the at least one of the plurality of riser tensioners.

11. The method of claim 9, wherein at least one of the plurality of riser tensioners includes a fluid volume speed control valve which acts to limit a volumetric rate of fluid flow in the at least one of the plurality of riser tensioners upon sensing a predetermined volumetric rate of flow in excess of a predetermined critical volumetric rate of flow.

12. The method of claim 9, wherein at least one of the plurality of riser tensioners includes an orifice-controlled fluid valve, and wherein a second timer delays closure of the orifice-controlled fluid valve for a second preselected time period after determining that a preselected number of the plurality of velocity differences exceed a preselected critical velocity difference.

13. The method of claim 9, wherein the selected one of the plurality of piston travel velocities is derived from a piston distance travel signal.

14. The method of claim 9, wherein the selected one of the plurality of piston travel velocities is derived from a piston acceleration travel signal.

15. The method of claim 9, wherein at least one of the riser tensioners comprises an accumulation chamber and a piston bore chamber, and wherein the at least one fluid flow within the cable tensioner passes through the piston bore chamber.

* * * * *